US005487644A

United States Patent [19]

Ishigaki et al.

[11] Patent Number: 5,487,644

[45] Date of Patent: Jan. 30, 1996

[54] PUMP HAVING A SINGLE OR A PLURALITY OF HELICAL BLADES

[75] Inventors: Eiichi Ishigaki; Kazumitsu Oura; Takaharu Honda, all of Kagawa, Japan

[73] Assignee: Ishigaki Mechanical Industry Co., Ltd, Tokyo, Japan

[21] Appl. No.: 323,589

[22] Filed: Oct. 17, 1994

Related U.S. Application Data

[63] Continuation of Ser. No. 941,446, filed as PCT/JP91/00265, Feb. 28, 1991, abandoned.

[30] Foreign Application Priority Data

Feb. 13, 1987 [JP] Japan ..... 62-19618
Aug. 31, 1989 [JP] Japan ..... 1-102287

[51] Int. Cl.[6] ..... F01D 9/00

[52] U.S. Cl. ..... 415/220; 415/182.1; 415/206; 415/71

[58] Field of Search ..... 415/182.1, 191, 415/201, 208.1, 211.2, 219.1, 220, 71, 206

[56] References Cited

U.S. PATENT DOCUMENTS

| | | | |
|---|---|---|---|
| 3,010,402 | 11/1961 | King | 415/206 |
| 3,148,464 | 9/1964 | Jones | 415/206 |
| 3,156,190 | 11/1964 | Stable . | |
| 3,163,119 | 12/1964 | Huppert . | |
| 3,560,106 | 2/1971 | Sshlstrom | 415/206 |
| 3,771,900 | 11/1973 | Baehr . | |
| 4,063,849 | 12/1977 | Modianos . | |
| 4,193,737 | 3/1980 | Lemmon | 415/206 |
| 4,648,796 | 3/1987 | Maghenzani | 415/71 |
| 4,688,991 | 8/1987 | Howard | 415/206 |
| 4,792,282 | 12/1988 | Jordan | 415/71 |

FOREIGN PATENT DOCUMENTS

| | | |
|---|---|---|
| 8084 | 7/1957 | Japan . |
| 50020 | 1/1974 | Japan . |
| 181997 | 11/1982 | Japan . |
| 126588 | 8/1988 | Japan . |

OTHER PUBLICATIONS

"Die Pumpen in Meerwasserentsalzungsanlagen nach dem Mehrstufigen Entspannungsverdampfungs-Verfahren", vol. 113, No. 4, Mar. 1971, Manfred Lenhard.

*Primary Examiner*—John T. Kwon
*Attorney, Agent, or Firm*—Jones & Askew

[57] ABSTRACT

A vertical pump (1) having a single or plurality of helical blades (10, 11, 12) mounted on a forward end of a rotary drive shaft (2) of the pump. The pump is of nonblocked type in which the helical blade or blades (10, 11, 12) are disposed with superior balance with respect to the rotary drive shaft (2), and is wide in flow passage between blade portions of the helical blades. The pump is particularly suitable for sewage treatment or the like.

3 Claims, 3 Drawing Sheets

PUMP HAVING A SINGLE OR A PLURALITY OF HELICAL BLADES

This is a continuation of application Ser. No. 07/941,446, filed filed as PCT/JP91/00265, Feb. 28, 1991, now abandoned.

TECHNICAL FIELD

The present invention relates to a vertical pump having a single or a plurality of helleal or spiral blades and, more particularly, to a pump suitable for sewage treatment or the like.

BACKGROUND ART

Conventionally, in a vertical pump, a rotor having a plurality of blades extending radially in a plane perpendicular to a main spindle of the pump is arranged at a lower position within a easing of the pump and is rotated to execute drawing or suction of water from a lower end of the casing.

However, this vertical pump has the following disadvantages. That is, since the pump comprises the plurality of blades which are so spread as to extend radially in the plane perpendicular to the main spindle of the pump, toward the casing, a passing area of water stream or flow is limited or narrowed. Particularly, in a case where sewage is sucked or drawn, cloths and solid matters which may be contained in the sewage lodge within the pump.

Further, a centrifugal pump is known which is disclosed in Japanese Patent Laid-Open No. SHO 57-181997, as a pump having a single helical blade.

However, such a centrifugal pump has the following disadvantage. That is, since water drawn in a direction of the main spindle of the pump flows in a direction perpendicular to the main spindle, solid matters and the like lodge within the pump.

Furthermore, depending upon water pumping environment, there may be a case where a vertical type non-blocked pump is required.

It is an object of the invention to provide a vertical pump which is non-blocked and which is large in lift and in discharge quantity or delivery.

DISCLOSURE OF THE INVENTION

In order to achieve the above-described purpose, in a vertical pump according to the invention, a single helical blade is fixedly mounted on a tip of a rotary drive shaft of the pump, an outer peripheral edge portion of the single helical blade is in proximity with an inner surface of a casing of the pump, the casing extends in the direction of the rotary drive shaft, the helical blade is arranged with superior balance with respect to the rotary drive shaft, an interval between upper and lower blade portions of the blade is widened, and a plurality of long twisted guide vanes are arranged at a flow passage above the blade.

By this arrangement, even if water is water including cloths and solid matters such as sewage or the like, there is no case where the water drawn from a lower portion of the casing into between tile blade portions of the helical blade having the wide flow passage causes the pump to be clogged. Moreover, since the blade is contiguous to each other in a helical form so as to be formed into a single blade extending upwardly, it is possible to raise the lift. Further, since the blade is arranged with superior balance with respect to the drive shaft, there is less in case where harmful oscillation or vibration occurs in the pump. Furthermore, water flow pumped up helically is adequately and gradually straightened or uniformed by the plurality of twisted long guide vanes so that there is less that harmful vibration occurs in the pump.

In an aspect, the pump is brought to a vertical oblique-flow pump in which a configuration of the casing at a portion in which the helical blade and the guide vanes exist is brought to a bowl or pot type configuration.

In an alternate aspect, in order to further improve the pump performance, a plurality of helical blades each having the above-described aspect are arranged with them in shift in phase with equal intervals each other about the rotary drive shaft of the pump.

With the above arrangement, volumetric efficiency is raised, and it is possible to increase the lift. Furthermore, it is possible also to enlarge the caliber or aperture of the pump so that the discharge quantity or delivery can increase. Generally, since enlargement of the aperture of the pump increases the dimension of the blade so that its weight considerably increases, balance with respect to the drive shaft of the blade is apt to be deteriorated by the single helical blade so that harmful vibration is generated in the pump and the efficiently of the pump is reduced. In the pump according to an embodiment of the invention, however, since the plurality of helical blades are arranged, the balance is extremely improved so that vibration imparted to the pump is extremely reduced. In a case where there are two helical blades, suction ports and discharge ports within the casing are located shaft-symmetrically with respect to the main spindle of the pump. Accordingly, balance becomes superior. Moreover, also in a case where there are three helical blades, since the suction ports and the discharge ports are similarly distributed symmetrically, there can be produced similar advantages.

BEST MODE FOR CARRYING OUT THE INVENTION

A pump having a single or a plurality of helical blades, according to the invention, will be described below in further detail with reference to the drawings.

Figure 1:
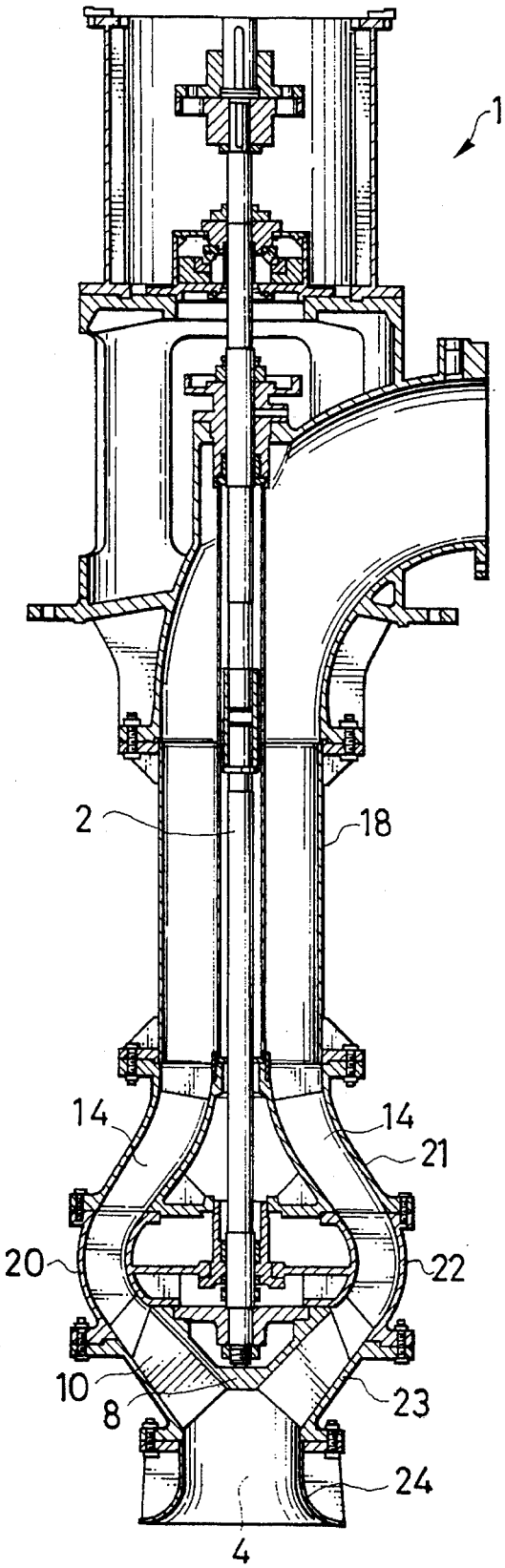
FIG. 1 is a schematic cross-sectional view showing a vertical pump having a single or two or more helical blades, according to the invention.

FIG. 1 is a schematic view showing a pump 1 according to the invention. A hub 8 is fixedly mounted on a forward end of a rotary drive shaft 2 which is rotated by drive means, for example, a motor (not shown). At least one helical blade 10 is mounted on the hub 8.

When the drive shaft 2 is rotated, water is drawn from a suction port 4 of a bell mouth 24 which is arranged below a casing 20 of the pump 1. The drawn water is straightened or uniformed by a plurality of twisted guide vanes 14 which are arranged above the helical blade 10 at a location within the casing 20, and is pumped up to a tube 18 at an upper portion of the casing 20. It is required that the guide vanes 14 gradually uniform the water flow pumped up helically along the helical blade, so as to flow straight within the tube 18, to eliminate evils such as vibration or the like to the pump. For this purpose, the guide vanes 14 are twisted about 270°. Moreover, the twisted guide vanes 14 are lengthened in order to obtain or produce adequate uniforming of the flow.

As a result that the guide vanes 14 are lengthened, the casing 20 is lengthened. Accordingly, the casing 20 is divided into multi-stage portions 21, 22 and 23 at a location between the helical blade 10 and the guide vanes 14 and at a location at an intermediate portion of each of the guide vanes 14, for the purpose of assembling and maintenance of the pump.

Figure 2:
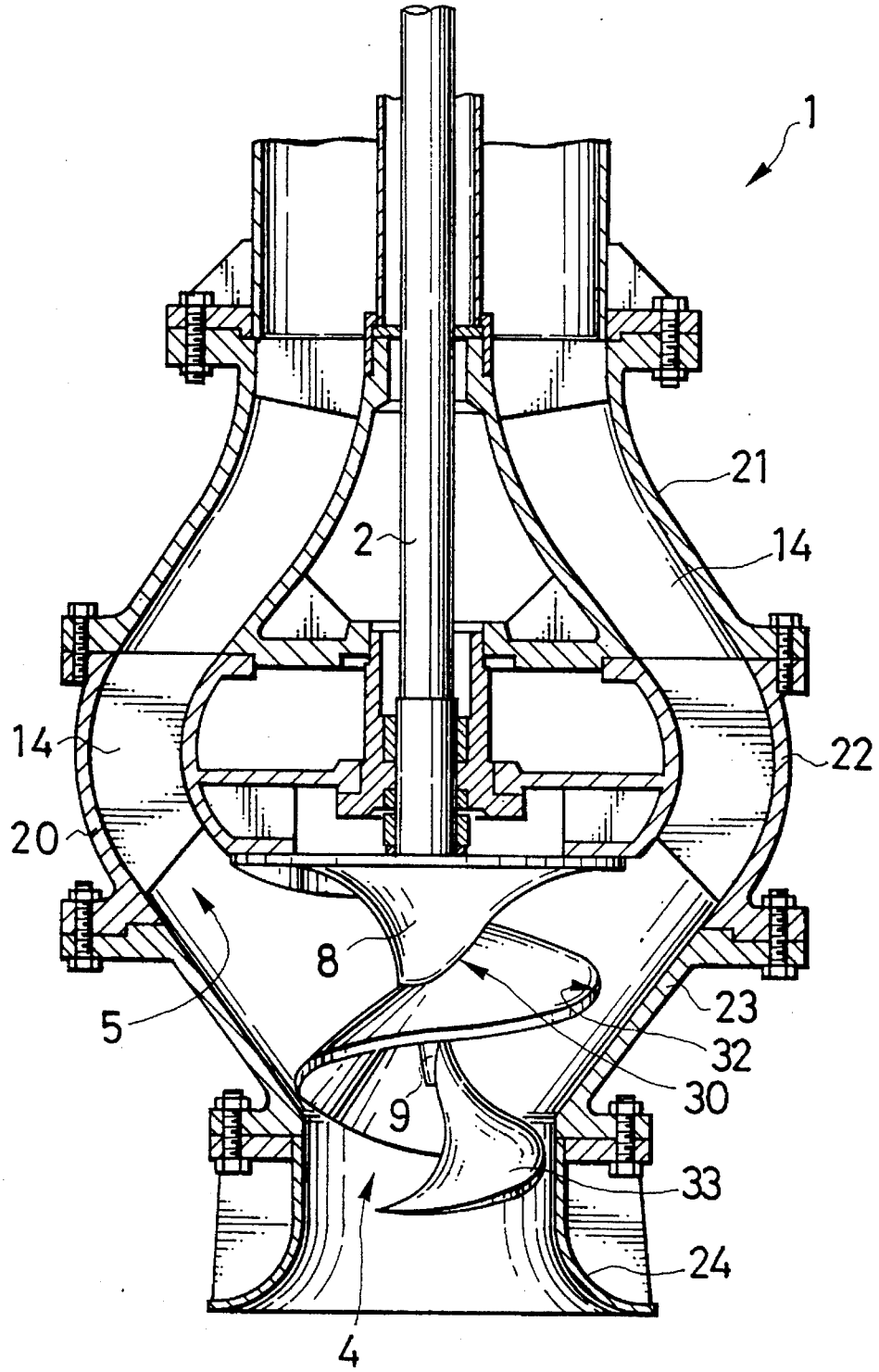
FIG. 2 is a partially cross-sectional view of a forward end portion of the pump illustrated in FIG. 1, showing a case having a single helical blade.

FIG. 2 is a partially cross-sectional side elevational view showing a principal portion of a lower end section of the pump illustrated in FIG. 1, showing the pump 1 having a single helical blade 10.

Description will be made to the helical blade 10. The blade 10 has a configuration thereof wound helically about the rotary drive shaft 2 through an adequate angle. The blade 10 is mounted on the hub 8 at a proximal end portion 30 of the blade 10. An outer peripheral edge portion 32 opposite to the proximal end portion 30 is in proximity with an inner surface of the casing 20. The hub 8 and the helical blade 10 may be formed integrally as a casting. A forward end potion 33 of the helical blade 10 extends downwardly more than a forward end portion 9 of the hub 8, whereby the wide suction port 4 is formed. The end portion 33 of the helical blade 10 extends downwardly more than the lower end of the casing 20 but less than the lower end of the bell-shaped mouth 24, as shown in FIG. 2. An interval between the upper and lower blade portions serving as a flow passage is adequately widened so as to allow cloths and solid matters included in sewage and the like pumped up, to pass.

When the drive shaft 2 is rotated, the pumped-up water is drawn from the suction port 4, flows toward a discharge port 5 through gaps between the blade portions, and is uniformed by the plurality of twisted guide vanes 14 each of which is long in length, as described previously.

The helical blade 10 is so formed that weight balance is superior with respect to the drive shaft 2. Further, the blade exists continuously over the predetermined length in the direction along the drive shaft, different from the conventional pump which has the plurality of blades only in a single plane perpendicular to the drive shaft 2. Thus, it is possible to increase the lift.

In the figure, the vertical oblique-flow pump 1 is shown whose configuration is such that a portion of the vertical oblique-flow pump 1 including the helical blade 10 and the guide vanes 14 of which casing 20 is swelled or bulged into the form of a bowl- or pot-like configuration. However, the vertical pump 1 may be a vertical axial-flow pump having no bowl portion and having a configuration in which the casing 20 is straight as a whole.

Figure 3:
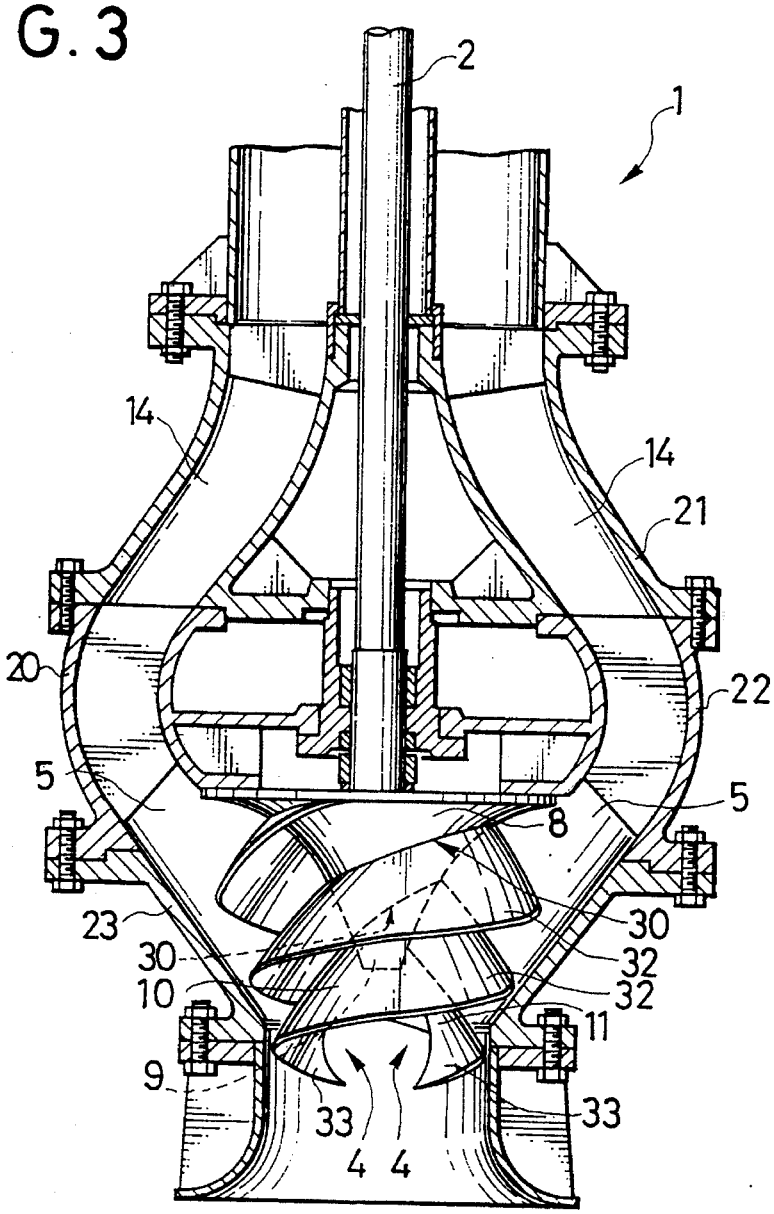
FIG. 3 is a partially cross-sectional view of a forward end portion of the pump illustrated in FIG. 1, showing a case having two helical blades.
Figure 4:
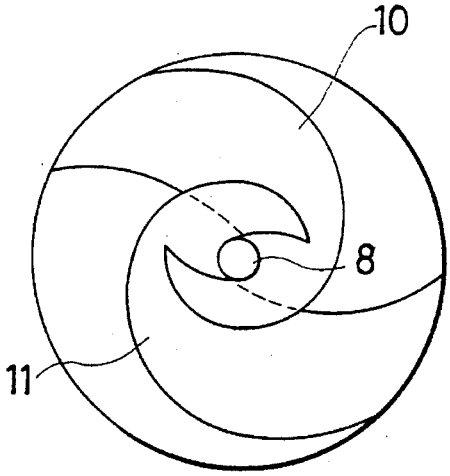
FIG. 4 is a bottom view of FIG. 3.

FIG. 3 is a partially cross-sectional side elevational view showing a principal portion of a lower end section of the pump 1 illustrated in FIG. 1. FIG. 4 is a bottom view of FIG. 3, showing the pump 1 having a pair or helical blades 10 and 11.

Each of the helical blades 10 and 11 is manufactured such that a sheet material is processed into a helical configuration. As will be understood from FIG. 4, the blades 10 and 11 are wound helically through 360° about the rotary drive shaft 2 of the pump 1 such that their phases shift 180° from each other so as to be symmetrical with respect to the shaft. The blades 10 and 11 are mounted on the hub 8 at their respective proximal end portions 30 and 30. Outer peripheral edge portions 32 and 32 opposite respectively to the proximal end portions 30 and 30 are in proximity with the inner surface of the casing 20. The forward end portions 33 and 33 of the respective helical blades 10 and 11 extend downwardly from the forward end portion 9 of the hub 8, to thereby form wide suction ports 4 and 4. An interval of the alternate blade portions of the two blades 10 and 11 serving as a flow passage is adequately widened so that cloths and solid matters included in the sewage and the like pumped up can pass.

When the drive shaft 2 is rotated, the pumped water is drawn simultaneously from the two suction ports 4 and 4 which are located in symmetrical relation to each other with respect to the shaft, passes through gaps between the blade portions, generates a flow in a single helical direction, flows into the two discharge ports 5 and 5 which are located in symmetrical relation to each other with reference to the shaft, and is uniformed by the plurality of twisted guide vanes 14 which are long in length, as described previously.

As described above, in a case where two helical blades 10 and 11 are provided in this manner, the blades are arranged symmetrically with respect to the shaft, and the suction ports and the discharge ports are also arranged in symmetrical relation to each other. Thus, the pump is brought to a pump extremely superior in balance. Further, in a case of a single helical blade, assuming that a single plane extending perpendicularly to the drive shaft 2 is considered, energy is given to the water at a single eccentric location, and energy cannot be applied equally, so that volumetric efficiency is bad. Generally, the delivery or discharge quantity of the pump is in proportion to the caliber or aperture of the pump. In a case of a single helical blade, however, it is impossible to cover the whole volume of the water for the reason discussed above. Accordingly, if the aperture of the pump increases, the discharge quantity does not increase in proportion thereto. On the other hand, in a case of a pump having two helical blades, energy is given to water at two locations symmetrical to each other with respect to the shaft, simultaneously in every or all planes extending perpendicularly to the drive shaft 2 so that the volumetric efficiency becomes superior. As a result, it is possible to raise the lift and enlarge the aperture of the pump in order to increase the discharge quantity. Tests have been conducted with respect to a vertical oblique-flow pump illustrated in FIG. 3. As a result, it has been known that efficiency is superior 4–5% as compared with the conventional oblique-flow pump.

Figure 5:
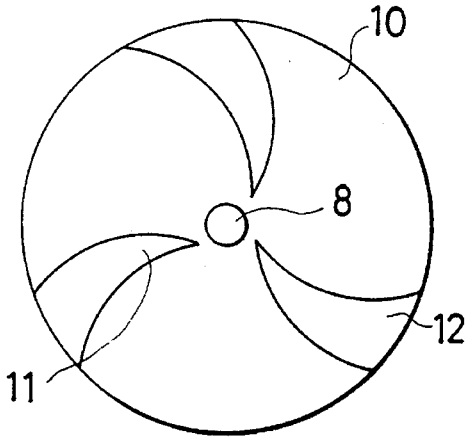
FIG. 5 is a bottom view showing a pump having three helical blades, according to the invention.

FIG. 5 shows a case where three identical helical blades 10, 11 and 12 are mounted on the hub 8 in place of the two helical blades of the pump illustrated in FIG. 3, with phases shifted 120° from each other. Also in this case, the blades as well as the suction ports and the discharge ports are dispersed equally similarly to the pump illustrated in FIG. 3, so that the pump is brought to a pump superior in balance and superior in volumetric efficiency.

It is preferable that the number of provided helical blades is decided depending upon a condition in which the dimension of the casing 20 of the pump 1 and the flow of the fluid within the pump are brought into uniformity, and other design conditions. In this connection, FIG. 3 shows the vertical oblique-flow pump 1 in which a portion including the helical blades 10 and 11 and the guide vanes 14 of the casing 20 are bulged in the form of a bowl or pot. However, the pump may be brought to a vertical axial-flow pump in which there is no bowl portion and which has a configuration in which the entire casing 20 is straight.

INDUSTRIAL APPLICABILITY

As described above, since the pump having a single or a plurality of helical blades, according to the invention, can be made large in lift and large in discharge quantity, there are produced advantages that a conventional relay station for pumping up arranged in a case where the lift is small can be omitted, and the like. Thus, it is possible to utilize the pump widely in various industries.

Moreover, since the flow passage within the pump is relatively wide and is a single direction in the direction of the drive shaft, things or objects do not lodge. Thus, the pump can also be utilized for pumping up of sewage or the like containing articles such as a block of cloth or paper which tends to block conventional pumps.

We claim:

1. A vertical pump wherein a plurality of blades (10, 11, 12) is fixedly mounted on a forward end of a rotary drive shaft (2) and wherein an outer peripheral portion (32) of each of said plurality of blades (10, 11, 12) is in proximity with an inner surface of a casing (20), characterized in that:

said casing (20) extending in the direction of said rotary drive shaft 92) has a bell mouth (24) fixed on a lower end of said casing (20) and a portion of said casing (20), surrounding said blades (10, 11, 12), has a configuration bulged in the form of a bowl;

said blades (10, 11, 12) are helical in configuration, and are arranged with their phases equidistantly shifted respectively about said rotary drive shaft (2);

each said helical blade has a forward end portion extending downwardly more than the lower end of said casing (20) and less than the lower end of said bell mouth (24);

a plurality of twisted guide vanes (14) is arranged at a flow passage in an upper portion above said helical blades (10, 11, 12) in said bowl-shaped configuration portion of said casing (20); and said bowl-shaped configuration portion of said casing (20), by which said helical blade (10, 11, 12) and said guide vane (14) are surrounded, is divided at a location between said blades (10, 11, 12) and said guide vanes (14) and at an intermediate portion of said guide vanes (14), whereby said casing is formed by three portions.

2. The vertical pump of claim 1, wherein two helical blades (10, 11) are mounted on said rotary drive shaft (2), said blades being arranged symmetrically with respect to said shaft with their phases shifted 180° from each other about said rotary drive shaft (2).

3. The vertical pump of claim 1, wherein three helical blades (10, 11, 12) are mounted on said rotary drive shaft (2), said blades being arranged with their phases shifted 120° from each other about said rotary drive shaft (2).

* * * * *